US012540533B2

(12) United States Patent
Gherren Noel et al.

(10) Patent No.: US 12,540,533 B2
(45) Date of Patent: Feb. 3, 2026

(54) GAS INJECTION VALVE IN AN OIL PRODUCTION COLUMN

(71) Applicant: OURO NEGRO TECNOLOGIAS EM EQUIPAMENTOS INDUSTRIAIS S/A, Rio de Janeiro (BR)

(72) Inventors: Felipe Gherren Noel, Petropolis (BR); Giancarlo Vilela De Faria, Rio de Janeiro (BR); Leonardo Gonçalves Candido Gomes, Rio de Janeiro (BR); Ricardo Naoyuki Alves De Moraes Sawaguchi, Rio de Janeiro (BR)

(73) Assignee: OURO NEGRO TECNOLOGIAS EM EQUIPAMENTOS INDUSTRIAIS S/A, Rio de Janeiro (BR)

( * ) Notice: Subject to any disclaimer, the term of this patent is extended or adjusted under 35 U.S.C. 154(b) by 0 days.

(21) Appl. No.: 18/688,577

(22) PCT Filed: Sep. 2, 2022

(86) PCT No.: PCT/BR2022/050353

§ 371 (c)(1),
(2) Date: Mar. 1, 2024

(87) PCT Pub. No.: WO2023/028685

PCT Pub. Date: Mar. 9, 2023

(65) Prior Publication Data

US 2025/0122782 A1 Apr. 17, 2025

(30) Foreign Application Priority Data

Sep. 3, 2021 (BR) ..... 102021017557-5

(51) Int. Cl.
*E21B 43/12* (2006.01)
*E21B 34/06* (2006.01)

(52) U.S. Cl.
CPC ..... *E21B 43/123* (2013.01); *E21B 34/066* (2013.01)

(58) Field of Classification Search
CPC .... E21B 43/121; E21B 43/122; E21B 43/123; E21B 43/1235; E21B 34/066
See application file for complete search history.

(56) References Cited

U.S. PATENT DOCUMENTS

| | | | | |
|---|---|---|---|---|
| 5,896,924 | A | 4/1999 | Carmody et al. | |
| 10,655,439 | B2 | 5/2020 | Murdoch et al. | |
| 11,035,201 | B2 | 6/2021 | Frazier et al. | |
| 2011/0308619 | A1* | 12/2011 | Martino | F16K 3/0254 251/65 |

FOREIGN PATENT DOCUMENTS

| | | |
|---|---|---|
| CN | 103328762 | 5/2016 |
| EP | 1250514 | 4/2005 |
| GB | 2264137 | 8/1993 |
| WO | 0106130 | 1/2001 |

* cited by examiner

*Primary Examiner* — Kristyn A Hall
(74) *Attorney, Agent, or Firm* — Dale Paul DiMaggio; Malin Haley DiMaggio & Bowen, P.A.

(57) ABSTRACT

A gas injection valve in an oil production column which guarantees the gas lift operation, providing secure closure, with greater reliability in the safety conditions of the integrated sets of safety barriers, enabling sensors to be integrated for monitoring the status of the gas lift valve.

6 Claims, 4 Drawing Sheets

GAS INJECTION VALVE IN AN OIL PRODUCTION COLUMN

I. CROSS REFERENCE TO RELATED APPLICATIONS

This application claims the benefits of, and priority from, Brazil Patent Application Number 1020210175575 filed Sep. 3, 2021, and PCT International Patent Application Number PCT/BR2022/050353 filed Sep. 2, 2022.

II. STATEMENT REGARDING FEDERALLY SPONSORED RESEARCH OR DEVELOPMENT

N/A

III. COPYRIGHT NOTICE

A portion of the disclosure of this patent application contains material this is subject to copyright protection. The copyright owner has no objection to the facsimile reproduction by anyone of the patent document or patent disclosure as it appears in the Patent and Trademark Office patent files or records, but otherwise reserves all copyrights whatsoever.

FIELD OF THE INVENTION

Specification of patent of invention for gas injection valve in an oil production column, and more specifically, in actioning the valve employed in the gas lift operation, with a view to providing secure closure, with increased reliability of the safety conditions of the integrated sets of well safety barriers, further enabling various sensors to be integrated to monitor the status of the valve, operating conditions and of the well.

BACKGROUND OF THE INVENTION

The ongoing technological evolution in the oil and gas sector has made it possible to exploit reservoirs thus far considered unfeasible for production.

The focus on obtaining greater levels of production and recovery has encouraged the development of solutions that maximize the total volume of oil produced in a reservoir. Techniques such as artificial lift have been employed and improved over time.

Artificial lift methods are employed in reservoirs classified as non-emergent, which are characterized by not providing sufficient natural energy for carrying the fluid produced up to the surface in a viable manner.

In order to satisfy this need, artificial methods of energy intake are applied, in the form of sufficient temperature and/or pressure for the means, so it can be produced in a viable manner.

Even those reservoirs classified as emergent, during the course of their exploration, will show a fall-off in their natural levels of pressure and temperature, which will directly impact the production potential, and may attain unviable values, thereafter being classified as non-emergent, triggering the need to employ artificial lift methods for production continuity.

Today the industry of the sector utilizes various methods of artificial lift, with different actuation mechanisms, the selection being based on the analysis of the characteristics of the reservoir, of the oil, of the infrastructure available in the production unit, of the costs, as well as other factors.

Gas injection in the production column through the annular space constitutes a method of major versatility and is widely employed in the oil and gas industry for maintenance or increase in production levels.

This method is known as gas lift operation, where the gas is pressurized in the annular space and, by means of a one-way valve, is injected into the production column.

The injected gas dissolves in the fluid contained inside the production column, which is mostly crude oil, reducing its specific weight and, consequently, the hydrostatic column above, making it flow more easily to the surface, in light of the reduction of pressure difference required for such.

The infrastructure of the gas injection system essentially consists of a treatment unit, pressurization and gas control, positioned in the production unit; a transport line which connects said treatment unit to the well head, establishing communication with the annular space, and, positioned in the production column, one-way gas injection valves that communicate the annular space with the production column, known as gas lift valves.

PRIOR ART

Today the gas lift valves (1) are of the insertable kind, and are positioned in a mandrel which make up the production column. Said mandrel, known as gas lift mandrel, is characterized by containing a side pocket and passages that communicate the annular space with the production column by way of the gas lift valve.

The gas lift valves are one-way, and are designed to operate always open, in the direction of the annular space to the production column, and prevent the passage in the opposite direction, that is to say, from the production column to the annular space, a behavior that is obtained by using a check-type system.

The gas lift valve is opened and closed by pressure difference between the annular space and the production column, occurring in an entirely mechanized way, indirectly controlled by checking and applying pressure to the annular space, without any sensing integrated to the valve.

The gas lift valves are mechanically calibrated to open when a certain pressure value is attained, whereby permitting, under this condition, the passage of gas in the desired direction (from the annular space to the production column), and the gas may be injected continuously or in puffs.

For issues relating to the operational safety of the process, it is required that all wells contain two integrated sets of independent safety barriers, with the gas lift valves installed in the production column, beneath the subsurface safety valve and above the packer, as illustrated in FIG. 2, making up the first integrated set of safety barriers (1*a*) of the well.

For safety requirements, the wells must have two integrated sets of safety barriers, so that in the event of a failure of power, and consequent communication between the production column and the annular space, the second integrated set of safety barriers contain the incident, preventing further adverse effects.

On average, three gas lift valves are installed gas lift valves, and, depending on the specific characteristics of the well, there may be a need for a greater or lesser quantity of valves.

The gas lift valves employed in the conventional gas injection systems are calibrated for different opening pressures, the latter, presenting a lower pressure difference for opening, being responsible for the constant gas injection in the production column, while the others are responsible for the well start-up system.

The gas lift valve has a check-type one-way device consisting of an indirect opening and closing mechanism, sensitive to the pressure difference acting under the sealing component, which, when sufficient, compresses the resistance spring, displacing the sealing component, enabling the passage of fluid towards the pressure difference. Further, with the passage of the fluid, the pressure difference decreases, making the spring relax, returning the sealing component to the seal position, closing the passage; this working occurs intermittently during the entire gas injection regime in the production column.

The automatic spring-closing mechanisms, as described previously, present operating problems that prevent the correct closing of the valve, and which, in extreme situations in the well, may cause an uncontrolled flow of fluid in the direction from the production column to the annular space, and this occurrence is listed in specific literature as one of the main results of failures involving gas lift valves.

The main causes that lead to this type of failure are residue deposits in the region of passage and/or sealing surface; wear of the components, due to the working regime; corrosion of components such as the rod of the main valve and/or of the retention valve, preventing uniform contact with the orifice; calibration error of the internal pressure of the valve; incorrect fitting into the side pocket; damages in the outer seals of the valve.

Another important operating factor to be highlighted is the set of the gas lift valve and the accommodation mandrel thereof, which are part of the integrated set of the primary safety barriers of the well, and which is normally deemed to be a set of fundamental elements to guarantee operating safety, and for this reason must be highly reliable.

What is seen today is that the gas lift valve is not designed and tested in accordance with the minimum requirements capable of guaranteeing the operational reliability and the integrity of the well, a failure of which compromises the integrity of the integrated set of primary safety barriers and, in turn, the safety levels of the well, and may ensue hefty fines for the parties responsible or even disasters and/or accidents.

Although companies invest in developing means that enhance the reliability and safety of the well equipment, including for example the annular safety system described in U.S. Pat. No. 5,329,999, the focus placed on gas lift valves and on gas lift mandrels is still minor.

Accordingly, it is desirable to propose a solution in which the gas lift valve and the gas lift mandrel have two main functions; namely gas injection, guaranteeing the gas lift operation (GL), and secure closure, guaranteeing the reliability of the integrated set of safety barriers of the well.

SUMMARY OF THE INVENTION

The main objective of the present invention is to propose a gas lift valve, actuated electrically, insertable in the side pocket of the mandrel, in the annular region, powered by means of an electric cable which, through the internal components, enables the continuity of just one power line for adjacent equipment.

Another objective of the present invention is to propose a gas lift valve that utilizes a sensor for measuring pressure and temperature, or vibration, connected to an electronic board responsible for the communication and control of the electric actuator of the valve, which may be a piezoelectric actuator, for example.

Another objective of the present invention is to propose a gas lift valve that incorporates a sliding jacket, endowed with orifices for the passage of the gas, and of the surrounding seals, connected to the flow opening and closing actuator under normal operating conditions.

Another objective of the present invention is to propose a gas lift valve that in the event of a failure and unexpected loss of power, provides a spring positioned so as to constantly exert force on the sliding jacket, in the direction of its closing, configuring a fail-safe-close mechanism.

Another objective of the present invention is to propose a gas lift valve that, in order to guarantee that the electric actuator does not lock with the open sliding jacket, when there is a power failure, provides a battery which, under normal operating conditions, is constantly charged, and, when there is a power failure, receives a signal from the electronic board to furnish sufficient energy to unlock the electric actuator, enabling the spring to return the jacket to the closed position, and when power is restored, the valve can again be controlled normally, the battery being repowered, in the event of a further failure, to furnish energy to the actuator again.

DESCRIPTION OF THE DRAWINGS

For improved understanding of the gas injection valve in an oil production column, reference is made to the accompanying drawings, such that it can be reproduced by a suitable technique which, characterizing its functionality, these drawings being merely illustrative, and may vary, provided that they do not stray from their functional principle, and wherein.

DETAILED DESCRIPTION OF THE INVENTION

Figure 1:
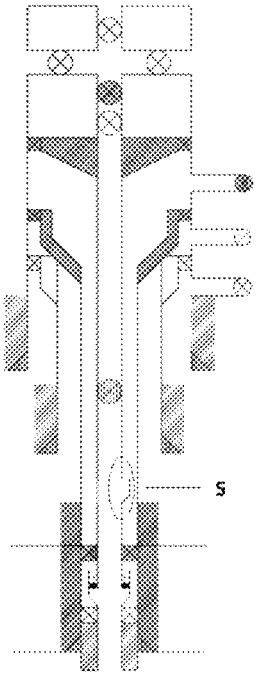
Prior Art Figure 1
FIG. 1 illustrates a schematic view of a prior art well, showing a production column with a mandrel where a gas lift valve (not illustrated) is installed, arranged below the subsurface safety valve and above the packer, forming the first integrated set of well safety barriers.
Figure 2:
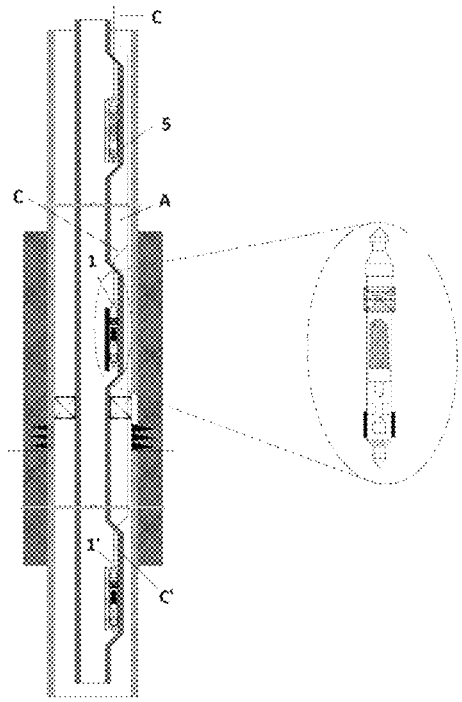
FIG. 2 illustrates a longitudinal sectional view of a production column with a prior art gas lift valve positioned in each mandrel.
Figure 3:
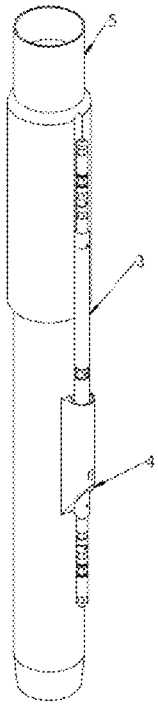
FIG. 3 illustrates a perspective view of a segment of a production column with a gas lift valve installed in the mandrel, according to the present invention.
Figure 4:
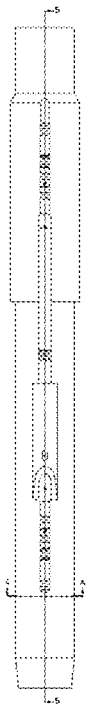
FIG. 4 illustrates a view of a segment of a production column with a gas lift valve installed in the mandrel, according to the present invention.
Figure 5:
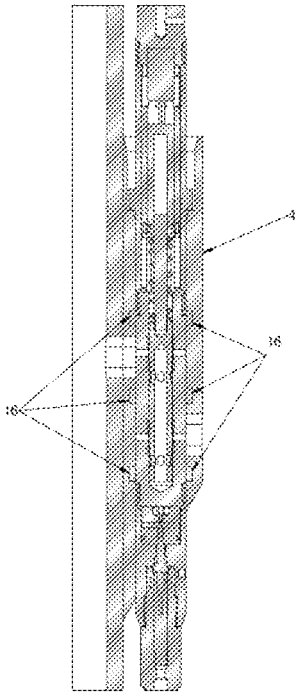
FIG. 5 illustrates a sectional view of a segment of a production column along line A-A of FIG. 4, showing the gas lift valve in the closed condition.
Figure 6:
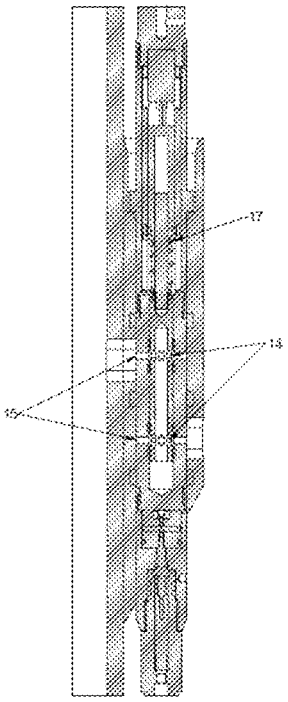
FIG. 6 illustrates a sectional view of a segment of a production column along line A-A of FIG. 4, showing the gas lift valve in the open condition.
Figure 7:
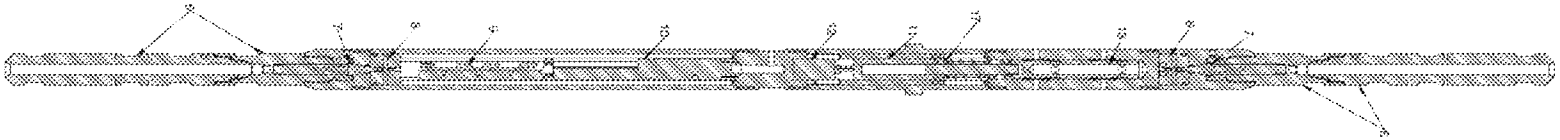
FIG. 7 illustrates a longitudinal sectional view of the gas lift valve assembly, according to the present invention along line B-B of FIG. 4.

According to what is illustrated in the figures, the gas lift valve (1) of the present invention is insertable in the side pocket (4) of the mandrel (5), in the annular region (A), powered by electric power cable (C), which passes through the mechanical connector (6), being connected to the electrical connector (7) for powering the valve; said electrical connector being connected to the branch connector (8), of the type described in patent BR102019025592-7, owned by the applicant, incorporated herein by reference, from where the energy derives for the embedded electronics (9), and to the branch connector (8) located at the other end of the valve, such that the energy can be conducted to the other electrical connector (7), which in turn connects to power cable at (C'), enabling the adjacent valve (1') to be powered, said embedded electronics (9) being responsible for acquiring the data from an adjacent sensor (10), represented herein by a pressure and temperature sensor, which may be a vibration sensor or other, as well as powering an electric actuator (11), further powering a battery (12); said electric actuator, having high efficiency and low energy consumption, such as a piezoelectric actuator, which is responsible for moving a sliding jacket (13), with orifices (14), to enable the passage of the artificial lift gas to the inside of the production column, when said orifices are aligned with the communication doors (15) with the production column for the passage of fluid from a mandrel (5) on which the valve is installed, having, around said sliding jacket, and between said orifices of the casing and of the mandrel, seals (16) to prevent the unwanted passage of fluid from the production column to the annular region, and vice-versa.

The battery, which is constantly charged by the power cable, which, in case of supply interruption, receives a signal from the electronics (9) to power the electric actuator (11) with enough energy to release it, enabling the return spring (17) to move the sliding jacket towards closing the valve, preventing fluid migration between the annular region and the production column, and, with the restoration of the energy supply, the electric actuator is once again commanded by the electronics, to open and close the valve, as the operator wishes, as well as recharging the battery so that it can operate again in the event of an energy supply interruption.

The instant invention has been shown and described herein in what is considered to be the most practical and preferred embodiments. It is recognized, however, that departures may be made therefrom within the scope of the invention and that obvious structural or functional modifications will occur to a person skilled in the art, and it is intended that such variations will be within the scope of the inventive subject matter and the appended claims.

What is claimed is:

1. A gas injection valve (1) for injecting artificial lift gas in an oil production column, said oil production column having an annular region (A) and a mandrel (5) in said annular region, said mandrel having a side pocket (4), said gas injection valve positioned within said side pocket;

said oil production column having an electric power cable (C), said gas injection valve powered by said electric power cable;

said gas injection valve having a mechanical connector (6), an electrical connector (7), and internal components;

said electric power cable passing through said mechanical connector to said electrical connector for powering said internal components;

said gas injection valve further having at least one branch connector (8), embedded electronics (9), a data sensor (10), an electric actuator (11), battery (12), a sliding jacket (13) having orifices (14), communication doors (15), seals (16) and spring (17);

said electrical connector being connected to said branch connector (8), for power to said embedded electronics (9), said embedded electronics (9) being responsible for acquiring data from said data sensor (10), as well as powering said electric actuator (11 for moving said sliding jacket (13) with said orifices (14), to enable the passage of said artificial lift gas to said production column, when said orifices are aligned with said communication doors (15) with said production column for passage of fluid from said mandrel (5) on which said gas injection valve is installed, having, around said sliding jacket and between said orifices and said mandrel (5), seals (16) to prevent the unwanted passage of fluid from the production column to said annular region (A), and vice-versa, in that said battery (12) is charged constantly by said electric power cable (C), and, in case of supply interruption, receives a signal from said embedded electronics (9) to power the electric actuator (11) with enough energy to release said sliding jacket (13), enabling said spring (17) to move said sliding jacket (13) towards closing said gas injection valve, preventing fluid migration between the annular region and the production column, and, with the restoration of the electric cable power supply, the electric actuator is once again commanded by the embedded electronics, to open and close the gas injection valve, as well as recharging the battery so that it can operate again in the event of a supply interruption.

2. The gas injection valve (1) in said oil production column according to claim 1, wherein said sensor is a pressure sensor and/or a temperature sensor.

3. The gas injection valve (1) in said oil production column according to claim 1, wherein said sensor is a vibration sensor.

4. The gas injection valve (1) in said oil production column according to claim 1, wherein said electric actuator is a piezoelectric actuator.

5. The gas injection valve (1) in said oil production column according to claim 1, wherein said battery provides power for releasing said electric actuator.

6. The gas injection valve (1) in said oil production column according to claim 1, further comprising:

said gas injection valve (1) having an additional branch connector (8), additional electrical connector (7) and additional mechanical connector (6);

said additional branch connector, electrical connector and mechanical connector for connection to an additional adjacent gas injection valve (1'); and said additional gas injection valve (1') being powered by said electrical power cable (C) at cable end (C'), eliminating the need for an additional power cable.

* * * * *